United States Patent [19]

Steinhart

[11] 4,140,234

[45] Feb. 20, 1979

[54] TURNING MECHANISM

[75] Inventor: Horst K. Steinhart, Anaheim, Calif.

[73] Assignee: Rima Enterprises, Santa Ana, Calif.

[21] Appl. No.: 768,030

[22] Filed: Feb. 14, 1977

Related U.S. Application Data

[63] Continuation-in-part of Ser. No. 736,843, Oct. 29, 1976, abandoned.

[51] Int. Cl.[2] ..... B65G 57/16

[52] U.S. Cl. ..... 214/6.5; 74/66; 74/600

[58] Field of Search ..... 214/6.5, 6 P; 74/66, 74/600

[56] References Cited

U.S. PATENT DOCUMENTS

| | | | |
|---|---|---|---|
| 2,576,765 | 11/1951 | Patterson | 74/600 |
| 2,741,169 | 4/1956 | Weiss | 74/66 |
| 3,006,258 | 10/1961 | Jochem | 214/6.5 |
| 3,075,403 | 1/1963 | Hepner | 74/600 |
| 3,532,230 | 10/1970 | Gutberlet et al. | 214/6.5 |

FOREIGN PATENT DOCUMENTS

| | | | |
|---|---|---|---|
| 64314 | 10/1949 | Netherlands | 74/66 |

*Primary Examiner*—L. J. Paperner
*Assistant Examiner*—Ross Weaver

[57] ABSTRACT

There is provided a turning mechanism for article orientation, as in a compensating stacker of printed signatures, which is characterized by a three link system including a stationary mounting block having mounted therein for rotation a turnable shaft, a rotating lever arm attached to the turnable shaft, and means for selectively moving the lever arm through 180 degrees of rotation.

8 Claims, 4 Drawing Figures

TURNING MECHANISM

This application is a continuation-in-part of my copending application Ser. No. 736,843, filed Oct. 29, 1976, now abandoned.

BACKGROUND OF THE INVENTION & PRIOR ART

Compensating stackers as such are not novel. U.S. Pat. No. 3,880,421 discloses apparatus for handling streams of sheet goods and utilizing a table which turns through 90° to provide a crisscrossed stack of signatures. A turntable which rotates through 180° for compensating purposes is shown in U.S. Pat. No. 3,568,578.

The present invention provides an entirely different and improved shaft rotating mechanism, and is particularly useful in a compensating stacker such as that described and claimed in my above-mentioned copending application.

BRIEF STATEMENT OF THE INVENTION

Briefly stated, the present invention is in an apparatus for converting linear motion to rotational motion in opposite directions through up to 180°. The apparatus is characterized by a shaft which is adapted to be rotated in opposite directions about its longitudinal axis. Onto one end of which may be attached any suitable surface or member whose rotation first in one direction and then in the opposite direction is desired. In a preferred utilization of the present invention, such member is a turntable in a compensating stacker.

The apparatus also includes a plurality of links. A first stationary link is provided in which the shaft is journaled for rotation, and which link serves as a frame mounted member for support of the linkage system and the member to be rotated. The first stationary link also includes a first pin which is disposed in parallel relation to the shaft. A second link is provided and mounted at one end for rotation on the first pin. The second link includes at its other end means for attaching thereto one end of a linearly extensible and retractable arm assembly. The second link includes between its ends a second fixed pin having an axis which is parallel to the axis of the first pin. A third link is provided and secured at one end to the shaft for rotation therewith and includes a longitudinally extending guide for sliding coaction with the second fixed pin. The third link is also arranged to coact with limit switches which effect reversal of the fluid flow to the extensible and retractable arm assembly, and corresponding change in the length of the arm.

As indicated, the combination also includes such an extensible and retractable arm assembly which coacts with the other end of the second link and is movable in a plane which is normal to the axis of the shaft. The extensible arm assembly actuates the links and effects rotation of the shaft about its axis through the linkage system. The amount of extension or retraction of the arm from or into the cylinder necessary in rotating the shaft in a clockwise direction and in a counter-clockwise direction through a selected angle is readily determined from the geometry of the apparatus.

The present apparatus is particularly useful in a compensating stacker of the type which is disclosed in detail in my copending application Ser. No. 736,843, the disclosure of which is incorporated herein in toto by reference.

BRIEF DESCRIPTION OF THE DRAWINGS

The present invention may be better understood by having reference to the annexed drawings wherein.

DETAILED DESCRIPTION OF THE DRAWINGS

Figure 1:
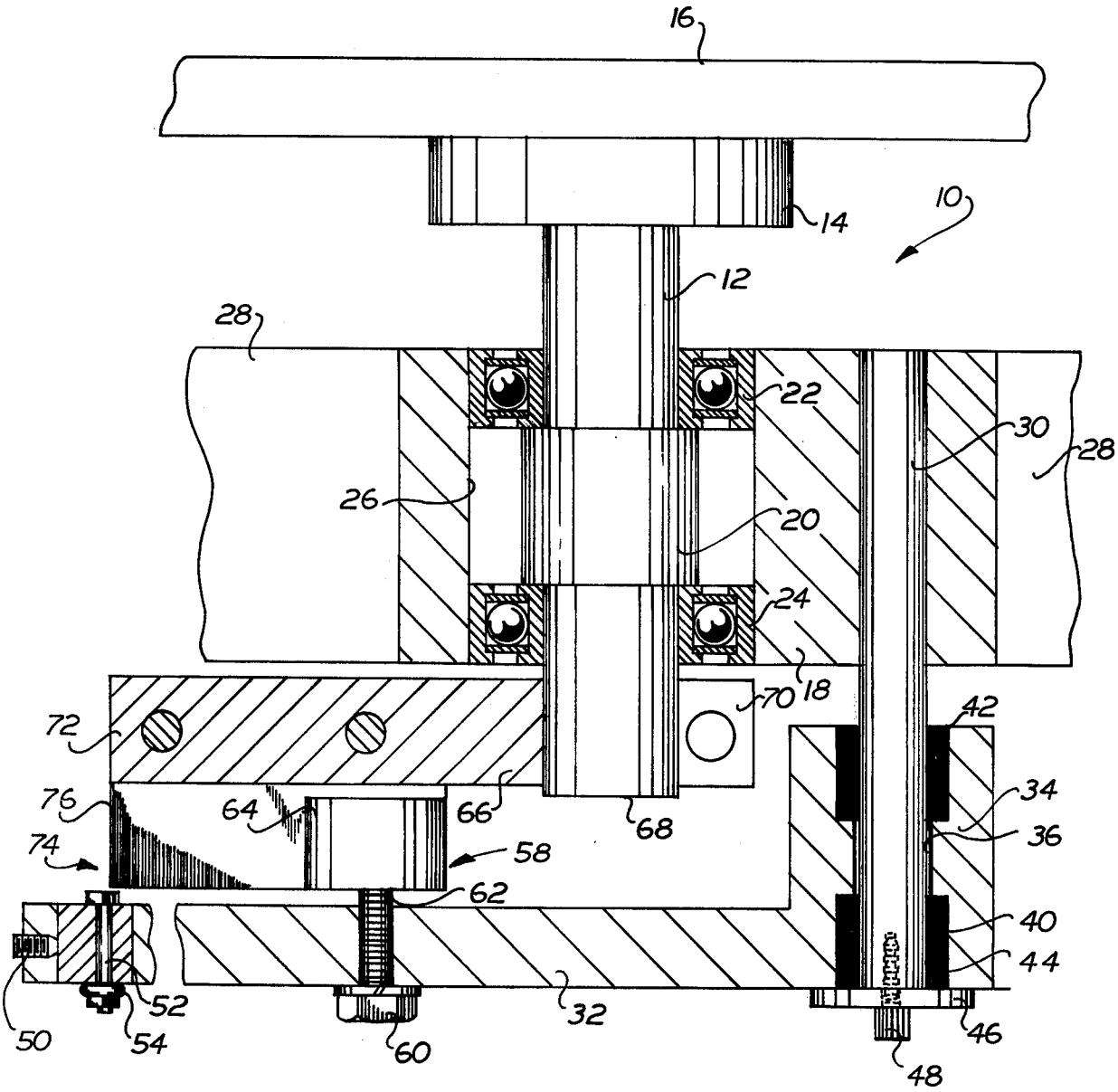
FIG. 1 is a cross-sectional plan view of a preferred form of apparatus in accordance with the present invention, and showing the apparatus attached to a turntable of the type used in a compensating stacker.
Figure 2:
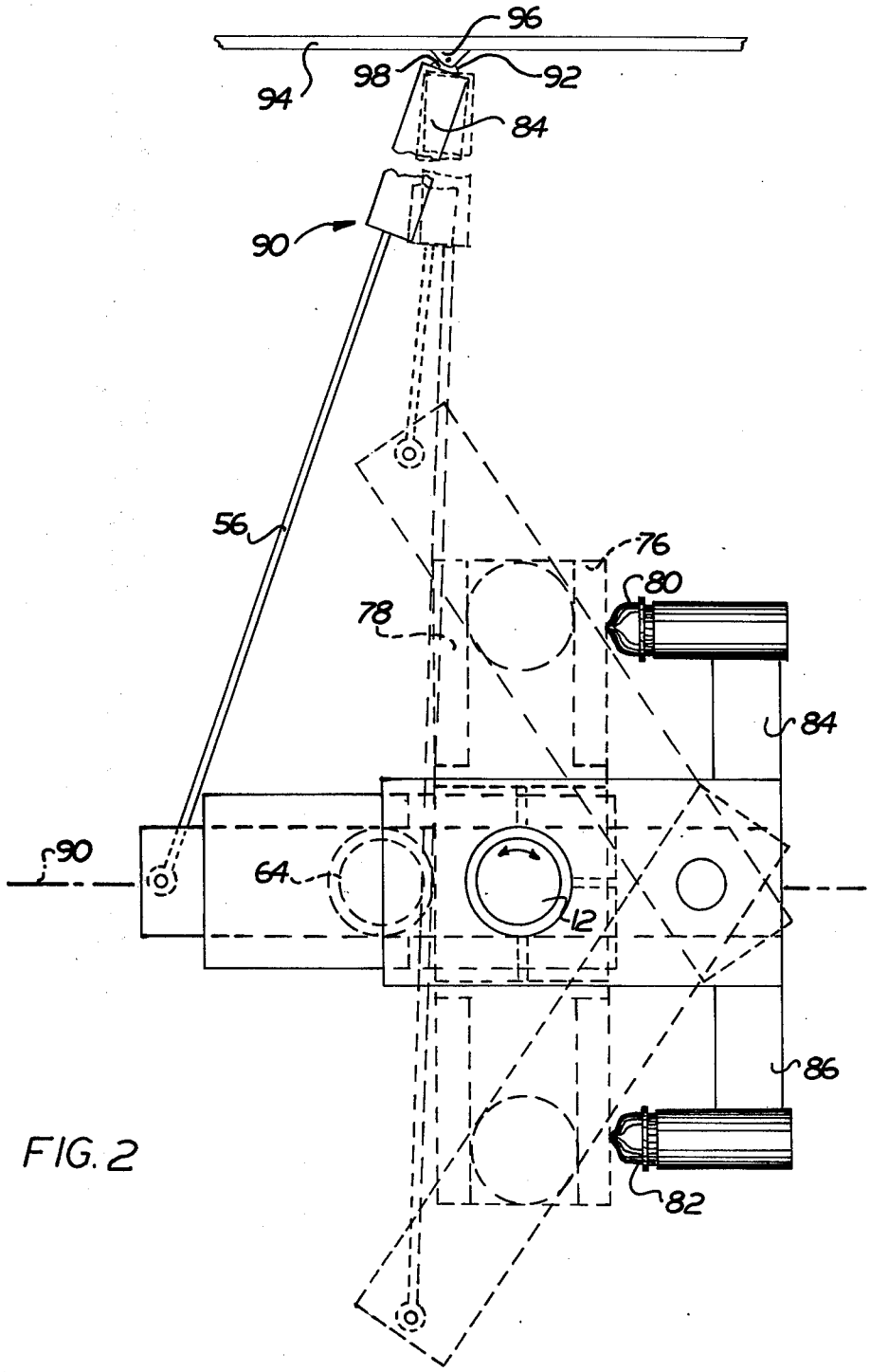
FIG. 2 is a top plan view on a reduced scale of the apparatus of the present invention and showing the apparatus set up for rotation of the turntable of FIG. 1 through 180° first in a clockwise direction and then in a counter-clockwise direction, these positions being shown in dotted lines.

Referring now more particularly to FIGS. 1 and 2 of the drawings, an apparatus for converting linear motion to rotational motion in opposite direction through up to 180° is generally indicated at 10. This apparatus comprises a shaft 12 which is in the embodiment shown in FIG. 1 is attached through a pedestal 14 to a turntable 16. The turntable 16 corresponds to the turntable 36 in my copending application Ser. No. 736,843.

The shaft 12 as clearly shown in FIG. 1 is journaled for rotation in a first link 18. In the embodiment shown, the shaft 12 is provided with an enlarged central portion 20 which serves as a spacer for ball bearings 22 and 24 which are suitably mounted in a bore 26 extending through the link 18. The first link 18 is a stationary link and is mounted by any suitable means such as welding or by bolts to a framework member 28, for example a framework member in a compensating stacker.

The first link 18 is provided with a pin 30 which is fixedly secured in the link 18 and has its axis parallel to the axis of the shaft 12.

A second or drive link 32 is mounted at one of its ends for rotation on the first pin 30. In the embodiment shown in FIG. 1, the line 32 is provided with a boss 34 which may be integrally cast with the link 32. The boss is suitably bored as at 36 to receive the pin 30, and counterbored as at 38 and at 40 to accept bushings 42 and 44 whereby the link 32 may rotate relative to the pin 30. The link 32 is secured to the pin 30 by any suitable means such as a washer 46 and a bolt 48.

Figure 1A:
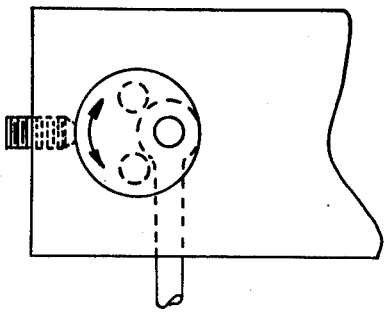
FIG. 1*a* shows a mode of attaching an extensible arm to a driving link to enable adjustment of the effective arm length.

The outer end 50 of the link 32 is conveniently provided with a pin 52 to which is attached by any suitable means to the distal extremity 54 of an extensible and retractable arm 56, hereinafter more particularly described. Any suitable pivot means for attaching the extremity 54 to the outer end of the link 32 may be employed. To enable fine adjustment of the effective length of the arm 56, the pin 52 is desirably mounted in an eccentric bushing 51 as shown in FIG. 1*a*.

The second link 32 is also provided with a pin structure 58 which, in the embodiment shown in FIG. 1 comprises a bolt 60 threadedly engaged in and projecting through the thickness of the second link 32 and having mounted on the projecting extremity 62 a needle bearing camfollower roller 64 which is conveniently although not essentially rotatable with respect to the pin 60.

There is also provided a third link 66 which is fixedly secured to the lower extremity 68 of the shaft 12 by any suitable means such as, for example, a split end which may be clamped by means of a bolt 70 about the lower end 68 of the shaft 12. Any suitable means of affixing the link 66 to the lower end 68 of the shaft 12 may be employed, for example a key and slot, or the like. Angular rotation, therefore, of the link 66 transmits such rotation to the shaft 12.

The third link 66 is provided adjacent its opposite extremity 72 with a longitudinally extending guide generally indicated at 74. In the preferred embodiment shown in FIGS. 1 and 2, the longitudinally extending guide is adapted for linear coaction with the pin 58 and includes a pair of parallel plates 76 and 78 suitably bolted to the sides of the link 66, and downwardly depending in order to trap the pin 58 with the roller 64 fixed thereto. Instead of the downwardly depending plates 76 and 78, the pin 58 may be dimensioned to extend up through a slot formed in the third link 66, as will be understood by those skilled in the art in view of this disclosure. Any suitable means for allowing linear motion of a pin assembly 58 relative to the third link 66 for transmission of angular motion of the second link 32 to the third link 66 may be employed.

As best shown in FIG. 2, limit switches are provided which coact with the third link 66 at the extremes of the clockwise and counter-clockwise rotation thereof for controlling fluid flow to extensible arm cylinder 100. The extent of angular rotation of the shaft is determined by the stroke of the extensible arm. In the embodiment shown in FIGS. 1 and 2, there are provided limit switches 80 and 82 which control the flow of air to an air cylinder 84 from which the extensible arm 56 extends. The length of the arm 56 and the distance it retracts into the cylinder 100 determines the extent of clockwise rotation of the shaft 12, and its length and the distance it extends from the cylinder 100 determines the extent of counter-clockwise rotation of the shaft 12 as viewed in FIG. 2. The effective length of the arm 56 may be changed by any suitable means, such as for example, that shown in FIG. 1*a* which is best adapted for fine adjustment of the arm length. Alternatively, the arm 56 may have two threaded parts joined by an adjusting sleeve provided with right and left threaded ends to effect adjustment of the length thereof and the extent of rotation of the shaft 12. The limit switches 80 and 82 are selectively positioned 180° apart in the embodiment shown by means of brackets 84 and 86 which may extend from opposite sides of the first stationary link, for example. The manner of mounting the limit switches 80 and 82 is, of course, optional. It will be observed that the location of the limit switches 80 and 82 may be in any desired position for actuation when the extent of rotation is, for example, 45° to either side of the center line 90, or any other extent of rotation as may be desired. The limit switches 80 and 82 are of conventional design and construction and their installation and operation to control the flow of air to the air cylinder 84 is well known and need not be described in detail herein.

In order to drive the apparatus of the present invention, there is conveniently provided an extensible and retractable arm assembly 90 (schematically represented) which is conveniently pivotally mounted at its proximal extremity 92 to another frame member 94 by means of a bracket 96 and a pin 98. The extensible and retractable arm assembly includes a cylinder 84, preferably air actuated, and still more desirably provided with internal air cushions at the ends of the cylinder for smoother operation. This assembly has an arm 56 which is movable into and out of the cylinder 84 in a known manner. The arm 56 is attached to a piston powered by air admitted into the cylinder 84 to one side or the other of the piston in response to the condition of the limit switches 80 and 82 whereby the arm 56 is driven in a direction to retract it into the cylinder 84 or in a direction to extend it from the cylinder 84, all in a known manner. Thus, the linear movement of the arm 56 is transmitted to the end of the second link 32 to rotate the second link 32 about its pin 30. This causes an arcuate movement of the pin assembly 58 which is transmitted through the roller 64 and the guide 74 to the third link 66 which effects rotation of the shaft 12. It should be noted that while the third link 66 in the embodiment shown in FIGS. 1 and 2 rotates through 180° in a clockwise direction, and then 180° in a counter-clockwise direction, the second link 32 moves through considerably less of an arc of rotation, for example approximately 110°. In the meantime, the extensible arm assembly 90 may pivot about the pin 98 through about 30°.

In the course of rotation from one extreme position shown in dotted lines in FIG. 2, 180° to the other extreme position also shown in dotted lines, the roller 64 will traverse, first in one direction and then in the opposite direction, the length of the guide 74 without escaping therefrom.

As indicated in the aforesaid application Ser. No. 438,843, an apparatus of the type herein particularly described is utilized as the means for rotating the turntable after it receives a predetermined number of signatures. These signatures are characterized in that one edge thereof is thicker by reason of folding or stapling, or a combination of both. Thus, after the accumulation of such a predetermined number, for example 15, it is necessary to rotate the table 16 (FIG. 1) 180° so that the next group of 15 signatures will have their thickened edges deposited in alignment with the thinner edges of the preceding batch of 15 signatures. When a group of 15 has been accumulated on the temporary platform of my prior application, mechanism is actuated in response to the count to drop the pile of 15 signatures onto the turntable. Thereupon, in response to the dropping action and a predetermined delay, air is supplied to one side of the piston in air cylinder 100 which causes the extensible arm 56 to extend or retract, as the case may be, to cause rotation of the turntable 180°, let us say in a clockwise direction. When the outside of plate 76 contacts the limit switch 80, the valving of the air to the cylinder/piston assembly 90 is reversed, so that on the next sequence, air is introduced into the cylinder 100 on the opposite side of the piston (not shown). This causes the arm 56 to extend fully to effect rotation of the third link 66 in a counter-clockwise direction and thus rotation of the shaft 12 and the turntable 16 in a counter-clockwise direction through 180° until the outside of plate 78 now engages the limit switch 82. The valving of the air is simultaneously reset through the action of limit switch 82 so that upon receipt of the next group of 15 signatures onto table 16, the operative cycle is reversed. The programming of the cycle to a predetermined number of items e.g. 15 signatures, and the timing of actuation in either the clockwise or the counter-clockwise direction forms no part of the present invention and may be accomplished by conventional means. It is also clear that manual valving of the air to the cylinder/piston assembly 90 may be employed, if desired. Thus, as a series of groups of 15 signatures is accumulated, by staggered disposition thereof in the manner indicated, the top of the pile remains substantially level and thus is compensated.

Figure 3:
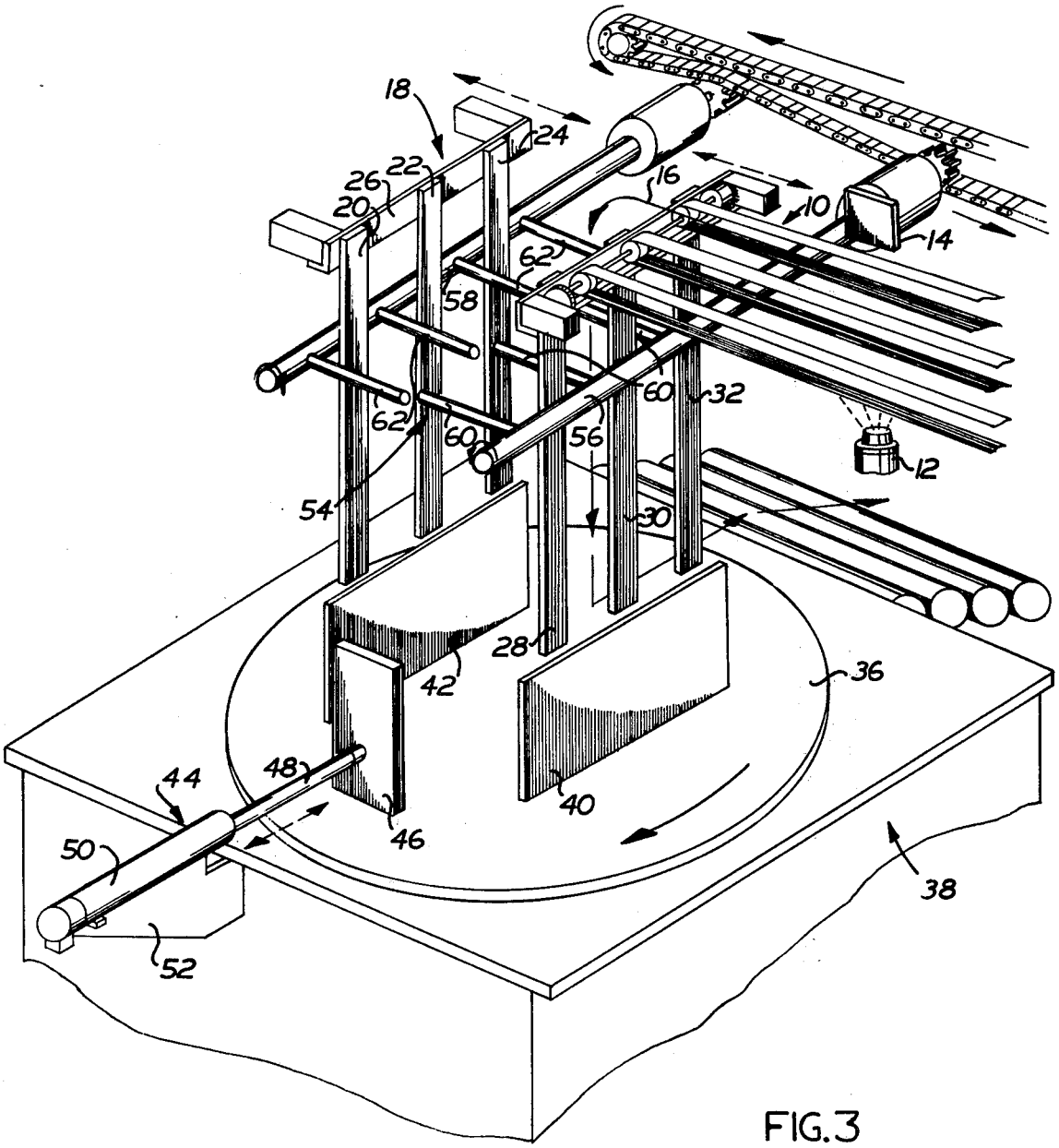
FIG. 3 is a diagrammatic partial perspective view of a compensating stacker in which the turning mechanism hereof is used.

Referring more particularly to FIG. 3, there is here shown in diagrammatic partial perspective, a compensating stacker utilizing a turning mechanism in accordance with the present invention. There is a supporting sidewall and shroud for the device which has been removed for visibility of the parts. Accordingly, there is shown a tape conveyor generally indicated at 110 for accepting signatures from a prior piece of apparatus, such as a trimmer. The taper conveyor 110 is of conventional structure and drive means, and in the embodiment shown it is desirable that the speed of the tape conveyor 110 be adjustable relative to the discharge speed of the apparatus performing the previous operation, e.g. trimming, so that the individual signatures being accepted therefrom enter a tape conveyor 110 moving at a slightly greater lineal speed in order to space the signatures apart for counting purposes. Associated with the tape conveyor, then, there is provided any suitable counting means such as for example a light source 112 and a light responsive sensor 114 which registers a count in suitable electronic apparatus (not shown) when the light beams from the light source 112 is interrupted.

The signatures carried by the tape conveyor 110 are discharged along a path indicated by the dotted line 116 into a vertical aligning or stacking frame generally indicated at 118. The frame 118 is adjustable in a known manner to accept signatures of a variety of sizes, within limitations imposed by the dimensions by the machine. A frame 118 is composed of vertical spaced alignment bars, for example alignment bars 120, 122 and 124 extending from a horizontal header bar 126 which is in turn attached to conventional adjustment means, not shown. In like manner from the opposite side, the frame 118 is provided with vertical alignment bars 120, 130 and 132. Suitable end frame members, such as end frame member 134 orthogonally adjustable relative to the previous mentioned frame portions may be provided again, in a known manner.

The stacking frame 118 provides, therefore, an adjustable column for accepting signatures from the tape conveyor 110 and collecting them in a stack. The frame 118 is supported above and stationary relative to a turntable 136 mounted for rotation on a suitable base generally indicated at 138. The turntable 136 is rotatable through 180° by an air operated slide crank mechanism such as shown in FIGS. 1 and 2 discussed above. The signature receiving surface of the turntable 136 is provided with adjustable vertical plates 140 and 142 adjustably movable toward and away from each other to accommodate the dimension across the opposite marginal edges of a stack of signatures. The turntable 136 is rotatable, for example clockwise through 180°, and upon the next 180° rotation, rotatable counter-clockwise.

The adjustable alignment plates 140 and 142 are adjusted so as to be in substantial vertical alignment with the alignment bars 120, 122 and 124 along one marginal edge of the signature, and the alignment bars 128, 130 and 132 along the opposite marginal edge of the signature.

When a suitable number of signatures has been collected on the turntable, it is ejected therefrom as a compensated pile by an ejector generally indicated at 144. The ejector includes a pusher plate 146 mounted at the distal extremity of a rod 148 projecting from an air cylinder 150 suitably supported on a bracket 152 and secured to the base 138. Conventional connections to the cylinder 150 are employed. The rod 148 has an extension sufficient when actuated by the cylinder 150 to push the entire stack of compensated signatures off the turntable 136 and onto a suitable conveyor such as roller conveyor where the compensated stack of signatures is received for wrapping, tying, or boxing by an operator.

There is provided intermediate the vertical ends of the alignment frame 118, a temporary platform generally indicated at 154. The temporary platform 154 is adapted to receive a plurality of signatures from the discharge end of the tape conveyor 110 and to accumulate a predetermined number of such signatures thereon. In response to the achievement of said predetermined number as determined by the sensor 114 and associated conventional electronics (not shown), the temporary platform 154 is withdrawn and the pile portion accumulated thereon allow to fall by gravity toward the turntable 136 and within the confines of the alignment bars 120, 122 and 124 along one marginal edge 128, 130 and 132 along the opposite marginal edge and between the alignment plates 140 and 142 on turntable 136. The temporary support 154 is formed, according to the invention of my prior application from a pair of parallel shafts 156 and 158 which are adjustably spaced and lie in a generally horizontal plane and preferably externally of the stacking frame 118. The ends of the shafts 156 and 158 are suitably carried in bearings mounted in sidewalls not shown. Shaft 156 is provided with a plurality of laterally extending fingers or tines 160 which extend radially from the shaft 156 and lie in a common plane. They are positioned along a single longitudinally extending element or line parallel to the axis of the shaft and on the surface thereof.

In like manner, the shaft 158 is provided with a plurality of inwardly extending fingers or tines 162 all lying in the same plane and extending from a common element or longitudinal line on the surface of the shaft 158 parallel to the axis thereof. The fingers 160 attached to the shaft 156 may be in axial alignment with the fingers 162 extending from the shaft 158, or they may be in staggered partially interleafed relation as desired. They are, nevertheless, spaced so as to be free from interference with the extending alignment bars 120, 122 and 124, and the alignment bars 128, 130 and 132. The shafts 156 and 158 are adapted to rotate in opposite directions as shown by the arrows at the ends of the shafts. Thus, when a pile portion containing a predetermined number of signatures has been deposited on the platform 154, and the count determined by the sensor matches with a preset count, the shafts 156, and 158 are rapidly rotated through 360° to allow the pile portion so formed and accumulated to drop toward the turntable 136 while rapidly reestablishing the temporary platform 154 in time to catch the next signature from the tape conveyor 110.

When the first pile portion has been received on the turntable 136, the mechanism for rotating the turntable 136 is actuated whereby it is turned through exactly 180° to await receipt of a succeeding pile portion now accumulating on the temporary platform 154.

The present turning mechanism structure is simple, positive acting, ruggedly constructed and most durable. Experience has shown that these devices are substantially trouble free in the field.

There has thus been provided an apparatus for article orientation, as in the case of a compensating stacker for printed signatures, which is characterized by a three link system including a stationary mounting block having mounted therein for rotation a turntable shaft, for example, a rotating lever arm attached to the shaft and link and slide means for selectively moving the lever arm through up to 180° of rotation.

What is claimed is:

1. An apparatus for turning a turntable in a compensating stacker alternately through 180° in a clockwise direction and 180° in a counter-clockwise direction comprising in combination:

(a) a turntable having an axially mounted shaft extending from the underside thereof;

(b) a first stationary link secured to the framework of said stacker, and in which said shaft is journaled for rotation, said link including a first pin mounted therein and in parallel relation to said shaft;

(c) a second link mounted at one end for oscillatory rotation on said first pin through an arc of less than 180°, and traversing the axis of said shaft in such oscillatory rotation, said link including at its other end means for attaching thereto one end of a linearly extensible and retractable arm assembly, said second link including intermediate its ends a second fixed pin having an axis parallel to the axis of said first pin; the distance between the axis of said first pin and the point of attachment of said arm assembly being greater than the distance between the axes of said first and second pins;

(d) a third link having a longitudinal axis and being secured at one end to said shaft for rotation therewith and including a longitudinally extending guide for sliding coaction with said second fixed pin, said guide being spaced from said shaft;

(e) an extensible and retractable arm assembly coacting with the other end of said second link and movable in a plane normal to the axis of said shaft for actuating said links and alternately selectively rotating and counter rotating said shaft about its axis through the same 180° angular rotation in each direction the free end of said extensible and retractable arm assembly being anchored to the framework of said stacker, and;

(f) means coacting with said extensible and retractable arm assembly to limit rotation of the third link to a maximum of 180° in each direction.

2. An apparatus in accordance with claim 1 wherein the second link traverses an extension of the longitudinal axis of the shaft on each movement thereof between said rotational limiting means.

3. An apparatus in accordance with claim 1 in which the shaft is attached at one end to a turntable.

4. An apparatus in accordance with claim 1 in which the extensible and retractable arm assembly includes an air actuated cylinder.

5. An apparatus in accordance with claim 1 in which the longitudinally extending guide includes a pair of parallel plates projecting from the surface of said third link.

6. An apparatus in accordance with claim 1 including limit switches coacting between said extensible and retractable arm assembly and said third link to control the direction of movement of said third link.

7. An apparatus in accordance with claim 1 in which the attaching means for said linearly extensible and retractable arm includes means for adjusting the effective length of said arm.

8. An apparatus in accordance with claim 7 in which the adjusting means includes an eccentric bushing having on off-center pin for attachment to said one end of said arm assembly.

* * * * *